US011264004B2

(12) United States Patent
McCutcheon et al.

(10) Patent No.: US 11,264,004 B2
(45) Date of Patent: Mar. 1, 2022

(54) PARALLEL NOISE CANCELLATION FILTERS

(71) Applicant: ams AG, Premstaetten (AT)

(72) Inventors: Peter McCutcheon, Premstaetten (AT); Robert Alcock, Premstaetten (AT)

(73) Assignee: AMS AG, Premstaetten (AT)

( * ) Notice: Subject to any disclaimer, the term of this patent is extended or adjusted under 35 U.S.C. 154(b) by 0 days.

(21) Appl. No.: 16/762,405

(22) PCT Filed: Nov. 15, 2018

(86) PCT No.: PCT/EP2018/081433
§ 371 (c)(1),
(2) Date: May 7, 2020

(87) PCT Pub. No.: WO2019/096930
PCT Pub. Date: May 23, 2019

(65) Prior Publication Data

US 2020/0349916 A1 Nov. 5, 2020

(30) Foreign Application Priority Data

Nov. 16, 2017 (EP) ..... 17202103

(51) Int. Cl.
*G10K 11/16* (2006.01)
*G10K 11/178* (2006.01)
(Continued)

(52) U.S. Cl.
CPC .. *G10K 11/17823* (2018.01); *G10K 11/17873* (2018.01); *G10L 21/0232* (2013.01);
(Continued)

(58) Field of Classification Search
CPC ..... H04R 1/1083; G10K 11/17873; G10K 2210/108; G10K 2210/1081; G10K 2210/3027; G10K 2210/3028
(Continued)

(56) References Cited

U.S. PATENT DOCUMENTS 4,494,074 A 1/1985 Bose
5,138,664 A 8/1992 Kimura et al.
(Continued)

FOREIGN PATENT DOCUMENTS

WO 2008/090342 7/2008

OTHER PUBLICATIONS

European Patent Office, International Search Report for PCT/EP2018/081433 dated Feb. 7, 2019.
(Continued)

*Primary Examiner* — Katherine A Faley
(74) *Attorney, Agent, or Firm* — MH2 Technology Law Group LLP

(57) ABSTRACT

A noise cancellation filter structure for a noise cancellation enabled audio device, in particular headphone, comprises a noise input for receiving a noise signal and a filter output for providing a filter output signal. A first noise filter produces a first filter signal by filtering the noise signal and a second noise filter produces a second filter signal by filtering the noise signal. The second noise filter has a frequency response with a non-minimum-phase, in particular maximum-phase. A combiner is configured to provide the filter output signal based on a linear combination of the first filter signal and the second filter signal.

19 Claims, 2 Drawing Sheets

(51) Int. Cl.
*G10L 21/0232* (2013.01)
*H04R 1/10* (2006.01)
*G10L 21/0216* (2013.01)

(52) U.S. Cl.
CPC ... *H04R 1/1083* (2013.01); *G10K 2210/1081* (2013.01); *G10K 2210/3027* (2013.01); *G10K 2210/3028* (2013.01); *G10L 2021/02163* (2013.01); *H04R 2460/01* (2013.01)

(58) Field of Classification Search
USPC ..... 381/71.1
See application file for complete search history.

(56) References Cited

U.S. PATENT DOCUMENTS

| | | | | |
|---|---|---|---|---|
| 5,182,774 | A | 1/1993 | Bourk | |
| 8,045,724 | B2 | 10/2011 | Sibbald | |
| 8,054,992 | B2 | 11/2011 | Sapiejewski | |
| 2011/0007907 | A1* | 1/2011 | Park ..... | G10K 11/17881 381/71.8 |
| 2012/0308024 | A1* | 12/2012 | Alderson ..... | G10K 11/17881 381/71.11 |
| 2014/0211953 | A1 | 7/2014 | Alderson et al. | |

OTHER PUBLICATIONS

Jeong, J.: "Analysis of nonminimum phase component on direct transfer function and its inverted transfer function" 2011 IEEE 15th International Symposium on Consumer Electronics, IEEE, Jun. 14, 2011, pp. 475-478.

* cited by examiner

PARALLEL NOISE CANCELLATION FILTERS

BACKGROUND OF THE INVENTION

The present disclosure relates to a noise cancellation filter structure, to a noise cancellation system with such a filter structure and to a signal processing method for noise cancellation purposes.

Nowadays a significant number of headphones, including earphones, are equipped with noise cancellation techniques. For example, such noise cancellation techniques are referred to as active noise cancellation or ambient noise cancellation, both abbreviated with ANC. Some people prefer the use of Active Noise Reduction or Ambient Noise Reduction, abbreviated as ANR. ANC respectively ANR generally makes use of recording ambient noise that is processed for generating an anti-noise signal, which is then combined with a useful audio signal to be played over a speaker of the headphone. ANC can also be employed in other audio devices like handsets or mobile phones.

Various ANC approaches make use of feedback, FB, microphones, feedforward, FF, microphones or a combination of feedback and feedforward microphones.

FF and FB ANC is achieved by tuning a filter based on given acoustics of a system. The best performing filters are typically IIR filters as good ANC can be achieved with a relatively low number of taps. As part of the design process for noise cancellation, the pathway of the noise from an ambient source into the ear needs to be characterised and compensated for with a filter. With any relatively closed headphone or earphone, this pathway can be via a front vent, rear vent (and through the speaker), a front to back leak, or via the plastics and earphone rubber tip or headphone ear cushion. This multitude of paths through which the noise can enter the ear, results in recombination of several noise signals at the drum reference point, DRP inside the ear canal. Each noise signal has a different amplitude and phase based on the pathway that they've taken.

It is often the case that at frequencies above 1 kHz (where passive attenuation is typically high), two or more signals recombine that are exactly 180 degrees out of phase, and thus a comb filter effect is present whereby a notch and subsequent notches at higher frequencies exist in the ambient to ear transfer function.

With a typical IIR filter stage, a notch can be matched with a second order stage, and more accurately with more stages. However, as the notch is tuned to become increasingly damped, the phase also becomes damped. Therefore in a conventional filter there is a linear relationship between the damping of the amplitude and phase response: If the notch is damped, the phase too will be damped. If the notch is undamped, the phase is undamped.

Such conventional filter structure is perfectly adequate at matching a notch caused by a simple acoustical or mechanical resonance. However, it cannot match a damped amplitude response with an undamped phase response.

SUMMARY OF THE INVENTION

This disclosure provides an improved signal processing concept for noise cancellation in an audio device like a headphone or handset that improves noise reduction performance.

Conventional ANC filter structures are designed to minimize delays introduced by the noise processing path, in order to provide a compensation signal to the loudspeaker that matches the ambient noise as fast and respectively accurate as possible. To this end, conventional ANC filters are generally designed as having a minimum phase in their overall transfer functions.

The improved signal processing concept is based on the idea of providing a filter topology that enables the filter to match the acoustic transfer function between an ambient noise source and a user's eardrum better in amplitude and phase by mimicking what is happening in the acoustic domain. For example, one or more notches that arise from the recombination of different signal paths in the headphone can be represented by a non-minimum phase behavior. Accordingly, a filter structure according to the improved signal processing concept is implemented by matching it to acoustics of an ANC-enabled audio device like a headphone and having an overall frequency response with a non-minimum phase between input and output of the filter structure.

One way to create such a filter shape is to arrange a non-minimum phase filter in parallel with the actual noise cancellation filter. For example, the non-minimum phase filter may be particularly implemented as a maximum phase filter, e.g. as an all-pass filter.

As the phase of the non-minimum phase filter reaches −180°, the two paths sum to create a notch. By adjusting the relative gains of each path, the damping of the amplitude of this notch can be changed, and the damping of the phase can be changed. Depending on whether the filter gain of the non-minimum phase filter is higher or lower than the gain of the main filter path, it can be determined whether the phase damping is linearly related to the amplitude damping or not. The result can be a filter shape with a damped notch amplitude response and an undamped phase response. This replicates what is happening in the acoustic domain.

In an embodiment according to the improved signal processing concept, a noise cancellation filter structure for a noise cancellation enabled audio device, in particular a headphone, comprises a noise input for receiving a noise signal and a filter output for providing a filter output signal. The filter structure is formed from a first noise filter for producing a first filter signal by filtering the noise signal, and a second noise filter for producing a second filter signal by filtering the noise signal. The second noise filter has a frequency response with a non-minimum phase, in particular a maximum phase. The filter structure further comprises a combiner configured to provide the filter output signal based on a linear combination of the first filter signal and the second filter signal.

For example, the noise signal at least partially represents ambient noise. The noise signal may be received from a noise microphone.

For example, the filter output signal is adapted to be used as a basis for a compensation signal in the noise cancellation enabled audio device.

For example, the second noise filter is implemented as an all-pass filter, preferably of at least the second order. For example, the second noise filter may be implemented as an infinite impulse response, IIR filter. A frequency of the pole/zero pairs of the all-pass filter may be associated with a notch in the effective acoustic transfer function of the audio device.

The first noise filter can be implemented as an IIR filter of at least the second order. The first noise filter may be designed with a minimum phase frequency response.

For practical implementations, the first and the second noise filter can be implemented as digital filters, for example within a digital signal processor, DSP.

A filter shape according to the improved signal processing concept allows a better degree of independence between the amplitude and phase response of a notch stage filter. In particular, a filter response with a low Q notch amplitude can have a phase response with a high Q notch. This greater independence means that the phase of a noise cancellation filter can better match the acoustics and improve the overall noise cancellation performance.

The acoustical response of an audio device like a headphone as described above can be matched by mimicking what is happening in the acoustical system. A conventional filter topology for the first noise filter, arranged with a simple delay filter as the second noise filter allows representing two or more different sound sources recombining in a user's ear canal. The delay filter, a type of non-minimum phase filter, can be tuned such that it is 180° out of phase with the main filter path at the exact frequency where a notch is required. The amplitude of the two signal paths of the first and the second noise filter can be adjusted, e.g. by adjusting parameters of the linear combination in a combiner, such that the phase and amplitude are damped appropriately.

For example, if the amplitude and phase of the audio device are both damped, this can be matched by making sure that an amplitude of the second noise filter in the delay path is less than amplitude of the conventional path with the first noise filter. However, if an undamped phase response is required together with a damped amplitude response, the amplitude of the delay path can be set to be more than that of the main filter path with the first noise filter.

Using an all-pass for the delay filter, for example implemented with a second order IIR filter, a delay with a flat amplitude response can be mimicked.

Generally speaking, an embodiment of a noise cancellation filter structure for a noise cancellation enabled audio device, in particular headphone, can be coupled between a noise input for receiving a noise signal and a filter output for providing a filter output signal. The filter structure is matched to acoustics of the audio device and has an overall frequency response with a non-minimum phase between the noise input and the filter output.

A noise cancellation filter structure according to the various embodiments described above can be used in a noise cancellation system for a noise cancellation enabled audio device like a headphone. Such a system, for example, further comprises a microphone input coupled to the noise input for receiving the noise signal and a compensation output for providing a compensation signal based on the filter output signal. For example, such a noise cancellation system further comprises an input for receiving a useful audio signal that is combined with the compensation signal in order to provide an audio output signal that can be played to a loudspeaker of the audio device. For example, such combination of the compensation signal with the useful audio signal is performed in an audio processor. The combined audio signal can be amplified within the noise cancellation system or outside by separate amplifiers. As in conventional ANC systems, the signal processing and combination of signals can be performed as well in the analog as in the digital domain, whichever is more suitable in the specific application.

Preferably, the noise cancellation system is implemented as a feed-forward noise cancellation system. However, usage of the filter structure according to the improved signal processing concept in a feedback noise cancellation system or a hybrid system is not excluded.

An embodiment of a signal processing method for a noise cancellation enabled audio device, in particular a headphone, comprises receiving a noise signal, filtering the noise signal with a first filter characteristic for producing a first filter signal, and filtering the noise signal with a second filter characteristic for producing a second filter signal. The second filter characteristic corresponds to a frequency response with a non-minimum phase, in particular a maximum phase. The method further comprises producing a filter output signal based on a linear combination of the first filter signal and the second filter signal.

The second filter characteristic may implement an all-pass filter, e.g. of at least the second order.

In some implementations, the method further comprises producing a compensation signal for the audio device based on a filter output signal.

Further implementations and embodiments of the method become apparent for the skilled person from the various implementations described above for the noise cancellation filter structure and the noise cancellation system.

BRIEF DESCRIPTION OF THE DRAWINGS

The improved signal processing concept will be described in more detail in the following with the aid of drawings.

Elements having the same or similar function bear the same reference numerals throughout the drawings. Hence their description is not necessarily repeated in following drawings.

In the drawings:

FIG. 1 shows an example headphone with several noise paths;

FIG. 2 shows an example implementation of a filter structure according to the improved signal processing concept;

FIGS. 3A and 3B show example frequency responses; and

FIG. 4 shows an example implementation of a noise cancellation system employing the improved signal processing concept.

DETAILED DESCRIPTION

Figure 1:
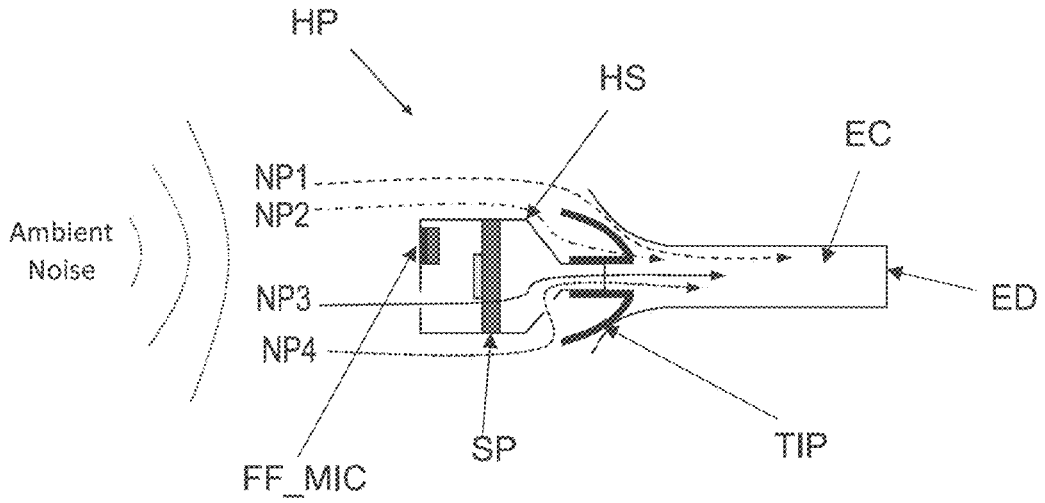

FIG. 1 shows a schematic example of a headphone HP, which is particularly shown as an earphone having an earphone rubber tip TIP placed in the ear canal EC of a user. The headphone HP has a speaker SP seated inside a housing HS and featuring for example a noise cancellation microphone FF_MIC. In this example, the microphone FF_MIC is placed inside the housing HS to act as a feed-forward microphone sensing primarily ambient noise. For example, the ambient noise can enter the housing HS through a rear vent so as not to restrict the movement of the membrane of the speaker SP. The housing HS further features a front vent opening, commonly implemented to avoid damage to the speaker SP on placing the earphones in the ear.

As can be seen in FIG. 1, sound from the speaker SP and the environment can enter the ear canal EC to reach the user's eardrum ED. For the ambient noise, there are several noise paths NP1, NP2, NP3, NP4 shown, each having different physical properties. For example, the first noise pass NP1 goes between the earphone rubber tip TIP and the ear canal EC. The second noise pass NP2 goes through the earphone rubber tip TIP. The third noise pass NP3 goes via the earphone rear vent and through the speaker and the noise path NP4 goes through the earphone front vent. Inter alia, each of the noise paths NP1 to NP4 has a different acoustic path length. In particular, each noise signal resulting from the respective noise paths NP1 to NP4 has a different amplitude and phase based on the pathway that they have taken. Moreover, the noise signals recombine at the eardrum ED, respectively the drum reference point, DRP, thereby effecting notches at some frequencies, where the noise signals have a phase difference of 180°.

Due to the nature of how these notches are formed, they could be highly damped in amplitude and sometimes are almost not noticeable. However, even when they are substantially damped, the phase response can appear to be very undamped.

Accordingly, there is a non-linear relationship between the damping of the amplitude and phase response. This behavior preferably is matched with an ANC filter.

Figure 2:
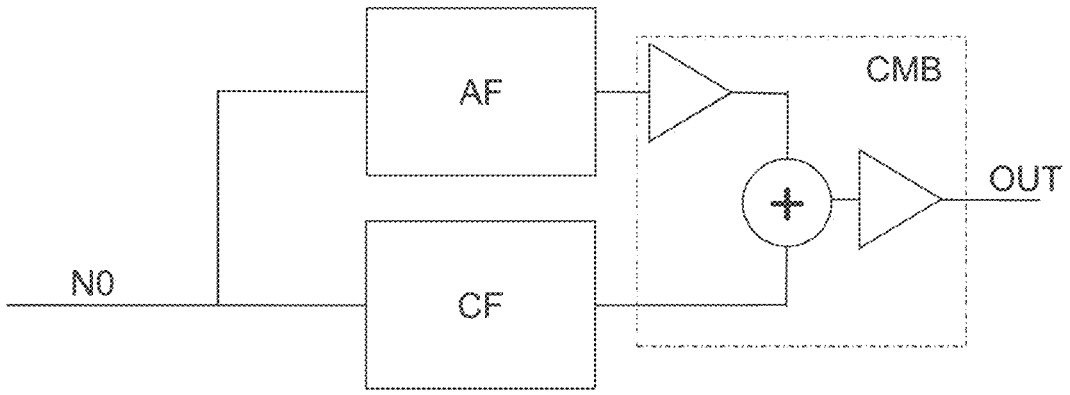

For example, FIG. 2 shows an implementation of a filter structure with a first noise filter CF filtering a noise signal NO. A second noise filter AF is connected in parallel and filters the same noise signal NO. The outputs of the first and the second noise filter CF, AF are provided to a combiner CMB that includes a gain stage after the second noise filter AF, a summer for summing up a first filter signal provided by the first noise filter CF and an amplified version of a second filter signal produced by the second noise filter AF. The output of the summer is provided to a further gain stage in the combiner CMB for producing a filter output signal OUT. Despite the specific implementation of the combiner CMB shown in FIG. 2, generally spoken, the combiner provides a linear combination of the first filter signal and the second filter signal to produce the filter output signal OUT.

The first noise filter CF may have a conventional filter structure as used in noise cancellation applications, for example an infinite impulse response, IIR, filter of at least second order. The second noise filter AF is implemented with a frequency response with a non-minimum phase, in particular maximum phase. For example, the second noise filter AF is implemented as an all-pass filter providing a specific delay to the processed signal resulting from its phase response, but having a flat amplitude response. For example, the all-pass filter may be of a second order or higher and is implemented as an IIR filter. In other implementations, the all-pass filter could also easily be implemented as a FIR filter or even as an analog allpass filter or as an analog delay line.

Preferably, the first and the second noise filter CF, AF are implemented as digital filters, for example in a DSP. The filter structure shown in FIG. 2 permits some independence between amplitude and phase of its frequency response, which when implemented as part of a noise cancellation system can increase the noise cancellation bandwidth.

For example, during operation, as the phase of the all-pass filter reaches −180°, the two paths sum to create a notch.

Figure 3A:
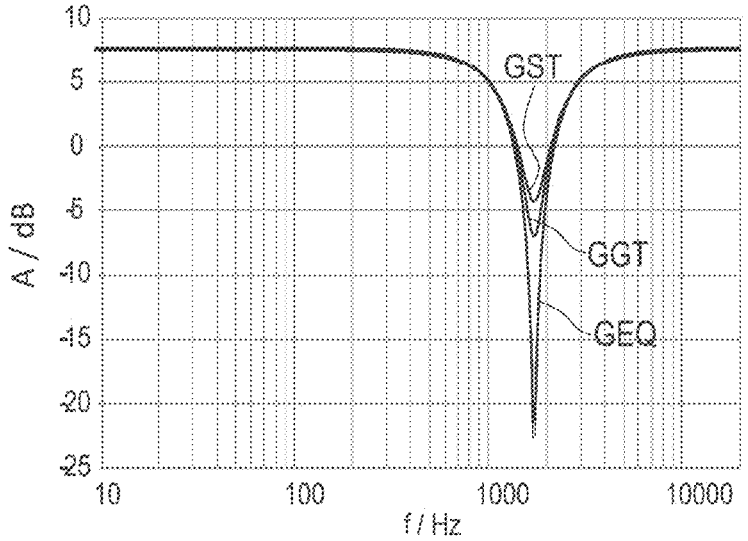
Figure 3B:
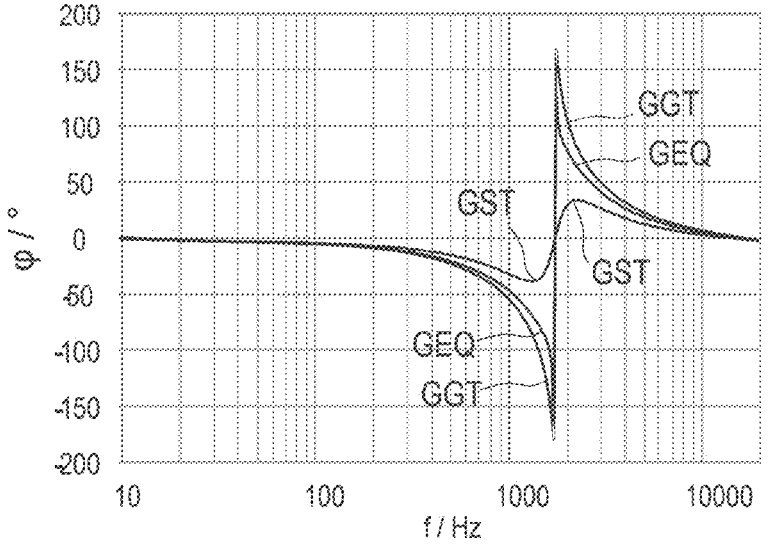

Referring now to FIGS. 3A and 3B, example frequency responses of the parallel filter structure of FIG. 2 where the first noise filter CF is implemented to match the acoustic response of the audio device respectively headphone HP. In this example, the acoustic response is assumed to be flat for simplicity. The second noise filter AF is implemented as an all-pass filter with a phase of −180 degrees at the notch frequency.

FIGS. 3A and 3B show three different constellations of the filter structure with different gain settings in the combiner CMB. The curve GST refers to a constellation where the gain of the all-pass pass is smaller than the gain of the conventional path with the first noise filter. The curve GEQ corresponds to a basically equal gain in the all-pass path and the conventional path. The third curve GGT corresponds to a constellation where the gain of the all-pass path is greater, in particular significantly greater than the gain of the conventional path.

As can be seen, depending on the gain relationship, an effective filter function can be achieved that has a high damping for the amplitude at the notch frequency while leaving the phase undamped at the frequency. Such behavior may better match the real-life acoustic properties of the earphone or headphone, thereby resulting in better noise cancellation performance.

Figure 4:
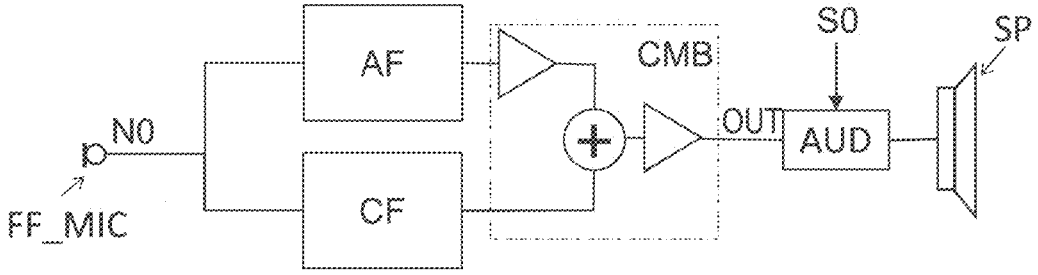

Referring now to FIG. 4, an implementation of the filter structure described in conjunction with FIG. 2 in a noise cancellation system is shown. In particular, the noise signal NO is provided by the microphone FF_MIC, which may be a feed-forward microphone as shown in FIG. 1. The filter output signal OUT, carrying a compensation signal for the ambient noise, is combined in an audio processor AUD with a useful audio signal S0 to provide a speaker output signal provided to the speaker SP. The processor AUD may be as simple as adding up the audio signal S0 with the filter output signal OUT such that the speaker signal contains both the useful signal and an anti-noise signal produced from the ambient noise via the filter structure. More complex functions of the processor AUD are not excluded.

Generally speaking, an arrangement like that shown in FIG. 4 allows to perform active noise cancellation with improved performance by receiving a noise signal NO, filtering the noise signal NO with a first filter characteristic for producing a first filter signal and filtering the noise signal NO with a second filter characteristic for producing a second filter signal. In particular, the first filter characteristic may be the filter characteristic of the first noise filter CF and the second filter characteristic may be the non-minimum phase characteristic or all-pass characteristic of the second noise filter AF. A filter output signal OUT is produced based on a linear combination of the first filter signal and the second filter signal. A compensation signal can be produced for the audio device based on the filter output signal OUT.

The filter structure for active noise cancellation according to the improved signal processing concept allows various applications, some of which are described as further examples in the following.

In one example implementation, a feed-forward noise cancellation headphone, earphone or handset comprises a feed-forward microphone, a speaker and a filter where the earphone has multiple pathways, through which noise can enter the ear such that the combination of two or more of these noise sources creates a notch shape in the ambient to ear transfer function and the filter has a response which matches said notch in amplitude and phase up to the notch resonant frequency.

In one example implementation, a feed-forward noise cancellation headphone, earphone or handset comprises a feed-forward microphone, a speaker and a filter where the earphone has multiple pathways through which noise can enter the ear such that the combination of two or more of these noise sources creates a notch shape in the ambient to ear transfer function and the filter has a response which matches said notch in amplitude by no less than 3 dB and in phase by no less than 20 degrees across a bandwidth of more than 100 Hz at any point in the octave directly below the notch resonant frequency.

In one example implementation, a feed-forward noise cancellation headphone, earphone or handset comprises a feed-forward microphone, a speaker and a filter where the earphone has multiple pathways through which noise can enter the ear such that the combination of two or more of these noise sources creates a notch shape in the ambient to ear transfer function and the filter is a non-minimum phase filter.

In one example implementation, a filter topology for a noise cancellation headphone, earphone or handset is represented by an all-pass filter in parallel to a conventional noise cancellation filter, or by any mathematically equivalent arrangement that will produce the same response.

In some implementations, a filter shape for a noise cancellation headphone, earphone or handset is arranged with at least one parallel path which contains one of an all-pass filter, a non-minimum phase filter or a simple time delay.

It should be noted that in all of the implementations described above, neither of the microphones nor the speaker SP are essential parts of a noise cancellation system according to the improved signal processing concept. Even the audio processor AUD could be provided externally. For example, such a noise cancellation system could be implemented both in hardware and software, for example in a signal processor. The noise cancellation system can be located in any kind of audio player, like a mobile phone, an MP3 player, a tablet computer or the like. However, the noise cancellation system could also be located within the audio device, e.g. a mobile handset or a headphone, earphone or the like.

The invention claimed is:

1. A noise cancellation filter structure for a noise cancellation enabled audio device, the filter structure comprising
- a noise input for receiving a noise signal;
- a filter output for providing a filter output signal;
- a first noise filter for producing a first filter signal by filtering the noise signal;
- a second noise filter for producing a second filter signal by filtering the noise signal, the second noise filter having a frequency response with a non-minimum-phase; and
- a combiner configured to provide the filter output signal based on a linear combination of the first filter signal and the second filter signal;
- wherein the filter output signal is adapted to be passed via an audio processor to a loudspeaker of the audio device;
- wherein the noise input comprises a microphone input for receiving the noise signal;
- wherein the filter structure further comprises a compensation output for providing a compensation signal that is generated by processing the filter output signal for being passed via the audio processor to the loudspeaker of the audio device; and
- wherein the filter structure is implemented as a feedforward noise cancellation system.

2. The filter structure according to claim 1, wherein the second noise filter is implemented as an all-pass filter.

3. The filter structure according to claim 2, wherein the all-pass filter is of at least second order.

4. The filter structure according to claim 1, wherein the second noise filter is implemented as an infinite-impulse response, IIR, filter.

5. The filter structure according to claim 1, wherein the first noise filter is implemented as an infinite-impulse response, IIR, filter of at least second order.

6. The filter structure according to claim 1, wherein the first noise filter and the second noise filter are implemented as digital filters.

7. The filter structure according to claim 6, wherein the first noise filter and the second noise filter are implemented within a digital signal processor.

8. The noise cancellation filter structure according claim 1, wherein the noise input is configured for receiving the noise signal from a noise microphone.

9. The noise cancellation filter structure according to claim 1, wherein the filter output signal is adapted to be used as a basis for a compensation signal in the noise cancellation enabled audio device.

10. The noise cancellation filter structure according to claim 1, wherein the noise signal represents ambient noise.

11. The filter structure according to claim 1, further comprising the audio processor being configured to provide an audio output signal based on a combination of the compensation signal with a useful audio signal.

12. A noise cancellation enabled audio device, comprising
- a noise cancellation filter structure according to claim 11;
- a noise microphone coupled to the microphone input; and
- the loud speaker for playing the audio output signal.

13. The audio device of claim 12, wherein the audio device is one of a headphone, an earphone, or a handset.

14. A noise cancellation filter structure for a noise cancellation enabled audio device, the filter structure comprising:
- a noise input for receiving a noise signal;
- a filter output for providing a filter output signal;
- a first noise filter, which has a minimum-phase frequency response, for producing a first filter signal by filtering the noise signal;
- a second noise filter for producing a second filter signal by filtering the noise signal, the second noise filter having a frequency response with a non-minimum phase; and
- a combiner configured to provide the filter output signal based on a linear combination of the first filter signal and the second filter signal.

15. A signal processing method for a noise cancellation enabled audio device, the method comprising
- receiving a noise signal from a microphone;
- filtering the noise signal with a first filter characteristic for producing a first filter signal;
- filtering the noise signal with a second filter characteristic for producing a second filter signal, the second filter characteristic corresponding to a frequency response with a non-minimum-phase;
- producing a filter output signal based on a linear combination of the first filter signal and the second filter signal; and
- producing a compensation signal for the audio device by processing the filter output signal for being passed to a loudspeaker of the audio device such that the compensation signal implements a feedforward noise cancellation.

16. The method according to claim 15, wherein the second filter characteristic implements an all-pass filter.

17. The method according to claim 16, wherein the all-pass filter is of at least second order.

18. The method according to claim 15, wherein the noise signal is received from a noise microphone.

19. The method according to claim 15, wherein the noise signal represents ambient noise.

* * * * *